United States Patent [19]

Chia-Tsai

[11] Patent Number: 5,033,336

[45] Date of Patent: Jul. 23, 1991

[54] STRUCTURE OF HAND-OPERATED SCRW DRIVER WITH HIGH DRIVING SPEED/HIGH TORQUE FORCE ALTERNATIVE SELECTION MECHANISM

[76] Inventor: Lai Chia-Tsai, No. 64, Chiu Dong Village, Tou Wu, Miao Li Hsien, Taiwan

[21] Appl. No.: 598,971

[22] Filed: Oct. 17, 1990

[51] Int. Cl.[5] ..... B25B 17/00

[52] U.S. Cl. ..... 81/57.3

[58] Field of Search ..... 81/54, 57, 57.3, 57.14, 81/57.31, 57.42

[56] References Cited

U.S. PATENT DOCUMENTS 3,992,964 11/1976 Osmond ..... 81/57.31

4,846,027 7/1989 Lu ..... 81/57.3

*Primary Examiner*—D. S. Meislin

*Attorney, Agent, or Firm*—Morton J. Rosenberg; David I. Klein

[57] ABSTRACT

Disclosed is a hand-operated screw driver with high driving speed/high torque force alternative selection mechanism. A planet gear transmission mechanism is provided having a linking-up shaft and a transmission shaft at two opposite ends respectively alternatively coupled with a driving shaft, which is driven to rotate by a handle, and an output shaft, which drives a screw driver blade for turning screws. The planet gear transmission mechanism is received inside a casing and controlled to rotate by a shift control member to alternatively change the position of the linking-up shaft with the transmission shaft so as to reduce the torque force and increase the speed or reduce the speed and increase the torque force in driving a screw driver blade to turn a screw.

3 Claims, 4 Drawing Sheets

STRUCTURE OF HAND-OPERATED SCRW DRIVER WITH HIGH DRIVING SPEED/HIGH TORQUE FORCE ALTERNATIVE SELECTION MECHANISM

BACKGROUND OF THE INVENTION

The present invention is related to screw drivers and more particularly to a hand-operated screw driver with high driving speed/high torque force alternative selection mechanism, which can be conveniently alternatively changed to reduce the torque force and increase the speed or reduce the speed and increase the torque force in driving a screw driver blade to turn a screw according to requirement.

Screw driver is a tool used for turning screws, having a blade that fits into the slot in the head of the screw. While driving a screw of 20 screw thread pitches by a hand-operated screw driver of the prior art, a screw must be turned 20 runs to completely fasten in an object. In actual practice to drive a screw into an object, more torque force is required only when a screw is approximately driven inside an object to the limit. When less torque force is required, same consumption of time may be required when a hand-operated screw driver is used. When less torque force is required, one may wish to drive a screw faster. However, this can not be achieved by using a hand-operated screw driver of the prior art.

SUMMARY OF THE INVENTION

The present invention has been accomplished under the circumstances in view. It is the main object of the present invention to provide a hand-operated screw driver which can be conveniently adjusted to alternatively increase driving speed or torque force according to requirement.

DETAILED DESCRIPTION OF THE PREFERRED EMBODIMENT

Figure 1:
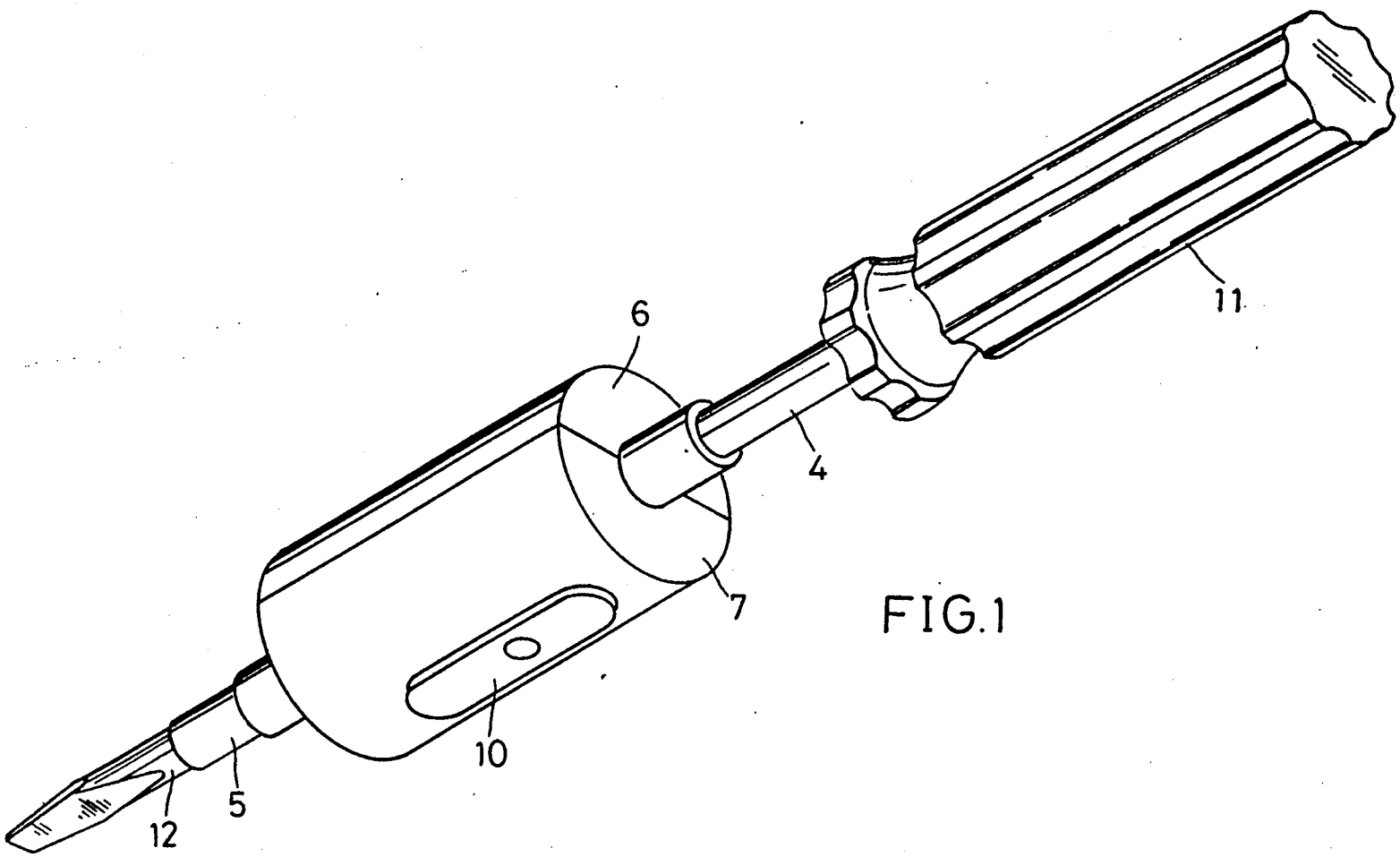
FIG. 1 illustrates a screw driver according to the present invention.
Figure 2:
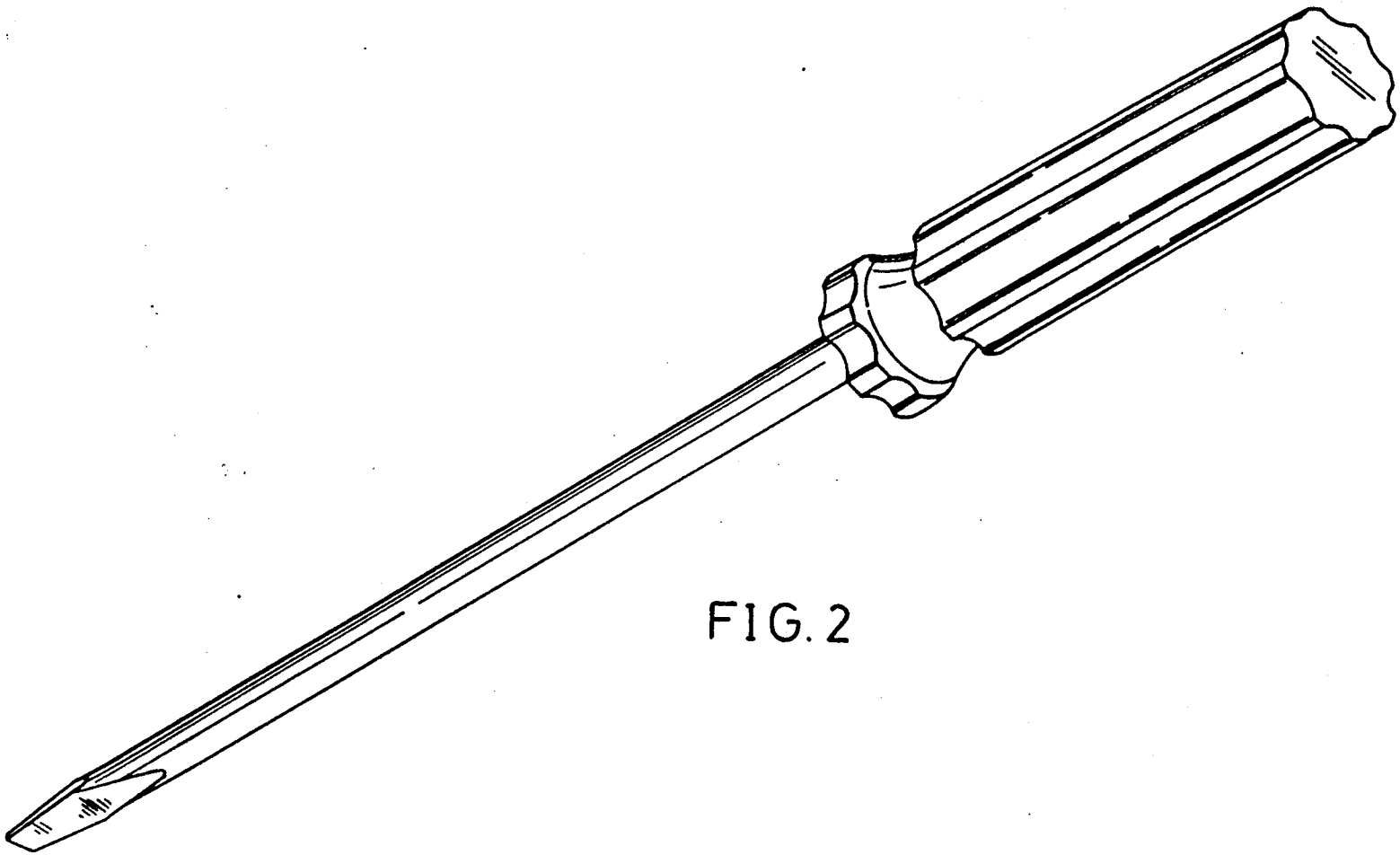
FIG. 2 illustrates a screw driver according to the prior art.

Referring to FIG. 1, a handle 11 is coupled with a driving shaft 4 which is inserted in a substantially cylindrical casing formed of two opposite shells 6, 7. The right-handed shell 7 comprises a control member 10 disposed externally at the center of the right side thereof. An output shaft 5 extends from the casing at the end opposite to the driving shaft 4 for carrying a screw driver blade.

Figure 3:
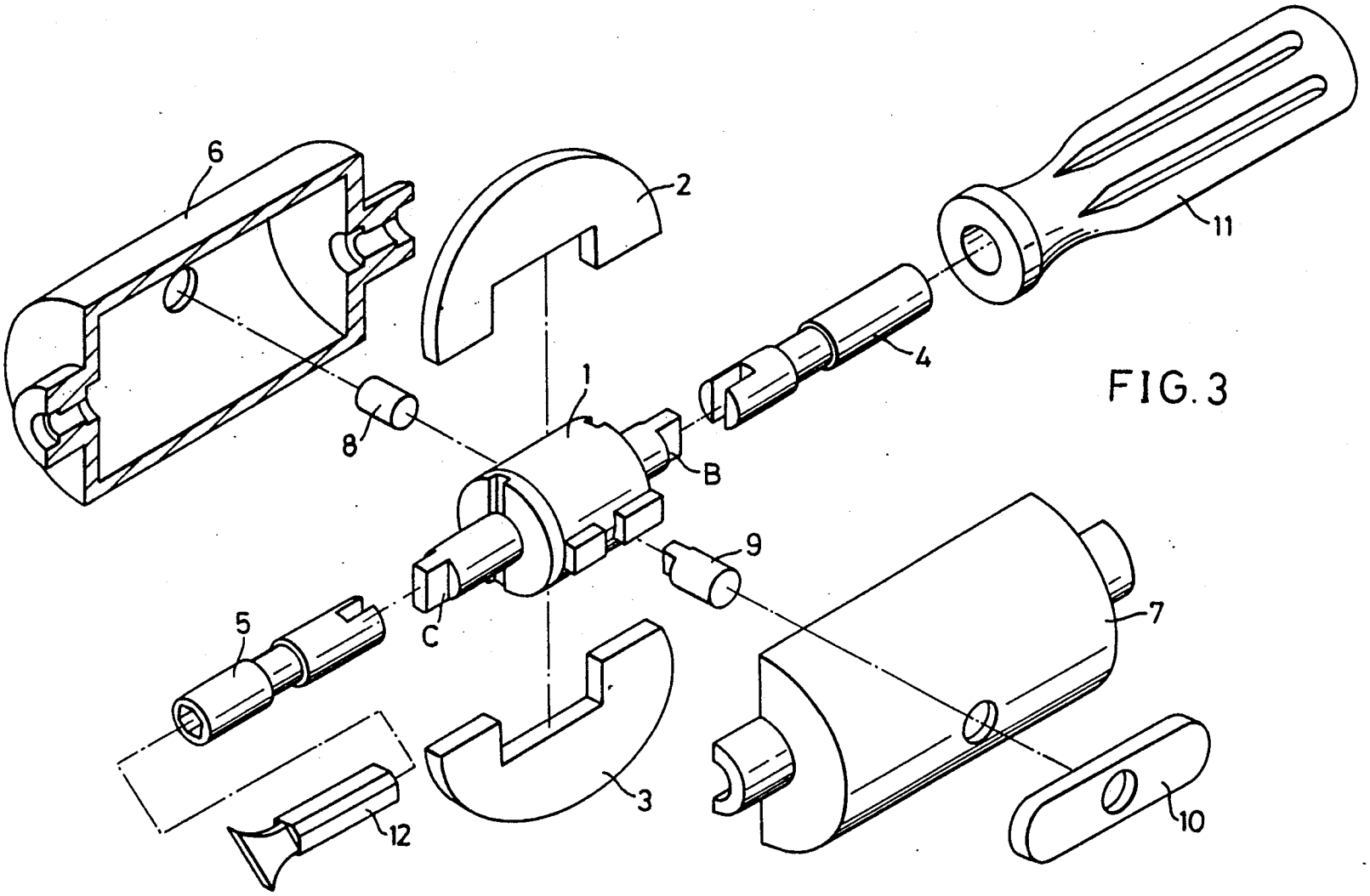
FIG. 3 is a perspective exploded view of the preferred embodiment of the present invention.

Referring to FIG. 3, there is a transmission gear box 1 having a linking-up shaft B and a transmission shaft C respectively extending therefrom at two opposite ends. The linking-up shaft B has a front projecting end releasably fastened in a notch on one end of the driving shaft 4 which has an opposite end coupled with the handle 11. The transmission shaft C has a bottom projecting end releasably fastened in a notch on one end of the output shaft 5 which has a hexagonal bore fitted with a permanent magnet for holding a hexagonal screw driver blade 12 of any preferable type for driving slotted or Phillips head screw. Two substantially semi-circular plates 2, 3 are vertically mounted on the transmission gear box 1 at two opposite ends. The two semi-circular plates 2, 3 have each a notch such that they form into a circle with the gear box 1 firmly retained therebetween after they are respectively attached to the gear box 1. A seat portion 101 is made on the transmission gear box 1 at the right side for the connection thereto of a rod 9 through tongue-and-groove connection, which rod 9 has an opposite end inserted through a hole 102 at the center of the right-handed shell 7 and fastened in the control member 10. Therefore, when the control member 10 is rotated through 180°, the transmission gear box 1 is simultaneously driven by the control member 10 through the rod 9 to rotate through 180° so as to drive the linking-up shaft B to move from a position in engaging with the driving shaft 4 to another position in engaging with the output shaft 5, i.e. the position of the linking-up shaft B is changed with the transmission shaft C. By means of turning the transmission gear box 1 180° leftwards or rightwards, quick driving speed or big torque force can be alternatively obtained according to requirement. There is provided a supporting rod 8 having one end fastened in the transmission gear box 1 and an opposite end fastened in a center hole on the left-handed shell 6 with the end surface thereof in flush with the outer wall surface of the left-handed shell 6. Through the support of the supporting rod 8, the transmission gear box 1 can be conveniently driven by the control member 10 to smoothly rotate on the supporting rod 8 for accurately changing the position of the linking-up shaft B with the transmission shaft C so as to reduce the torque force and increase the speed or reduce the speed and increase the torque force in driving a screw driver blade 12 to turn a screw.

Figure 4:
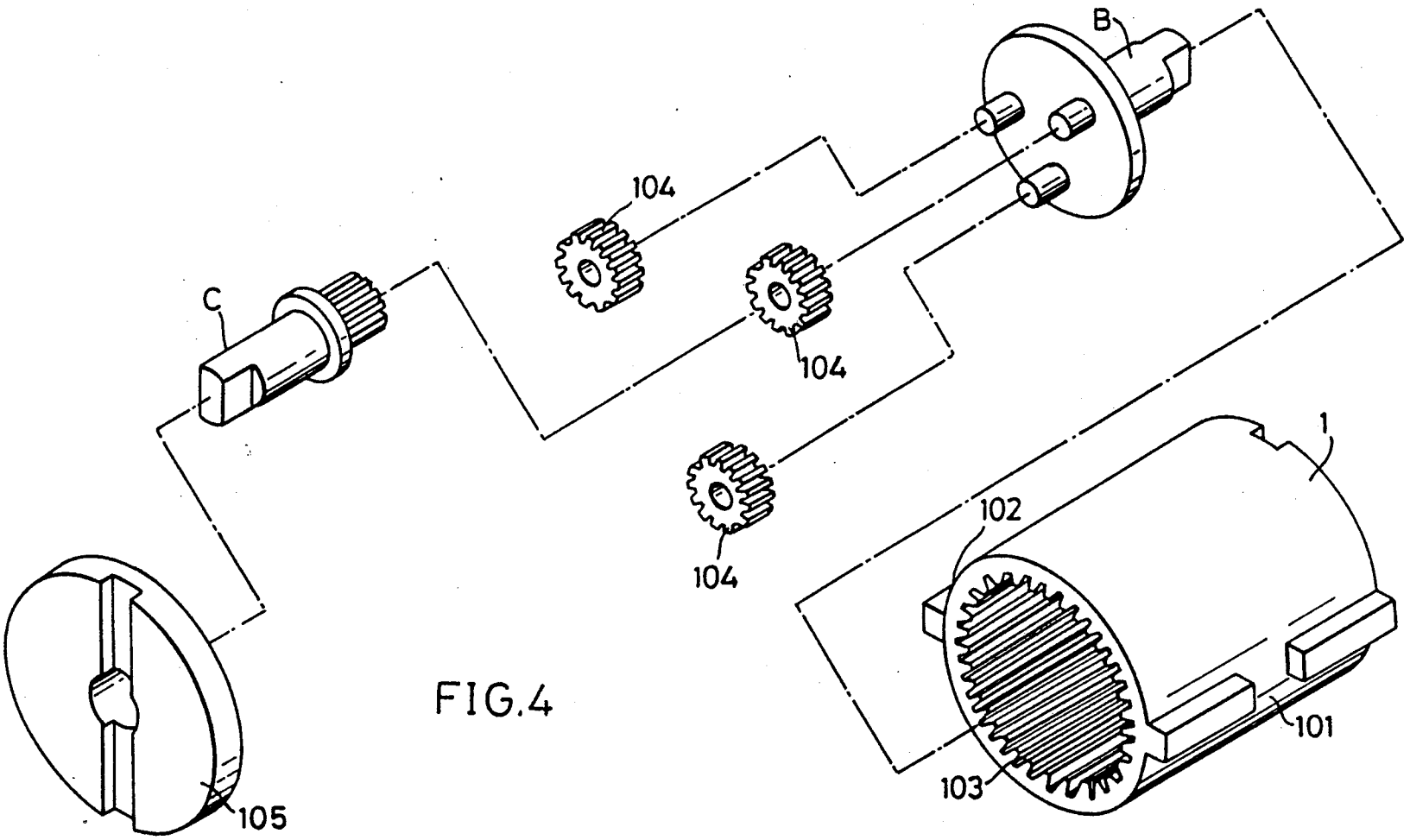
FIG. 4 is a perspective dismantled view of the transmission gear box of the preferred embodiment of the present invention.

FIG. 4 shows the inner structure of the transmission gear box 1. As shown in FIG. 4, three pinions 104 are respectively engaged between a toothed portion, which is externally made on the transmission shaft C at one end, and an internal gear portion 103, which is internally made on the inner wall surface of the gear box 1. The linking-up shaft 5 is integrally incorporated with a cover board firmly covered on the gear box 1 at one end for mounting the three pinions 104. There is still a cover board 105 covered on the gear box 1 at an opposite end through which the transmission shaft is fastened in the gear box 1. When the linking-up shaft B or the transmission shaft C is rotated, the transmission shaft C or the linking-up shaft B is simultaneously carried to rotate through the operation of the three pinions 104.

I claim:

1. A hand-operated screw driver, comprising:

a casing;

a gear box received inside said casing, having two opposite grooves at two opposite ends, an internal gear portion made around its inner wall surface, a linking-up shaft at one end, a transmission shaft at an opposite end, said transmission shaft having a toothed portion externally made thereon at one end, and three pinions secured to said linking-up shaft and respectively engaged between said toothed portion and said internal gear portion;

two semi-circular plates having each a notch at the middle and being received inside said casing and respectively attached to said two opposite grooves on said gear box at two opposite sides to form into a substantially circular shape;

a supporting rod fastened inside said casing permitting said gear box to rotate thereon;

a shift control rod fastened in a seat portion on said gear box opposite to said supporting rod and driven to turn said gear box to rotate;

a driving shaft releasably coupled with said linking-up shaft;

an output shaft releasably coupled with said transmission shaft;

a shift control member disposed out of said casing and coupled with said shift control rod for driving said shift control rod to turn said gear box to rotate;

a handle coupled with said driving shaft at an opposite end; and a screw driver blade fastened in said output shaft for driving screws.

2. The hand-operated screw driver of claim 1, wherein said linking-up shaft is integrally incorporated with a cover board firmly covered on said gear box at one end for mounting said three pinions on its inner face.

3. The hand-operated screw driver of claim 1, wherein said gear box has a cover covered thereon at an opposite end for the insertion therethrough of said transmission shaft, said cover having a groove vertically made on its outer face.

* * * * *